United States Patent [19]

Tsuchihashi et al.

[11] 4,398,123

[45] Aug. 9, 1983

[54] HIGH PRESSURE DISCHARGE LAMP

[75] Inventors: Michihiro Tsuchihashi; Ryo Suzuki; Masato Saito; Heiji Watanabe, all of Kanagawa, Japan

[73] Assignee: Mitsubishi Denki Kabushiki Kaisha, Tokyo, Japan

[21] Appl. No.: 450,151

[22] Filed: Dec. 15, 1982

Related U.S. Application Data

[63] Continuation of Ser. No. 235,406, Feb. 18, 1981, abandoned.

[30] Foreign Application Priority Data

| | | | |
|---|---|---|---|
| Feb. 20, 1980 | [JP] | Japan | 55-20126 |
| Feb. 29, 1980 | [JP] | Japan | 55-25824 |
| Feb. 29, 1980 | [JP] | Japan | 55-25826 |
| May 26, 1980 | [JP] | Japan | 55-69739 |
| May 29, 1980 | [JP] | Japan | 55-72008 |

[51] Int. Cl.[3] ..... H01J 7/44

[52] U.S. Cl. ..... 315/46; 315/104; 315/209 M

[58] Field of Search ..... 313/15, 39, 601; 315/46, 47, 104, 209 M

[56] References Cited

U.S. PATENT DOCUMENTS

| | | | |
|---|---|---|---|
| 2,238,352 | 5/1942 | Braselton | 315/99 |
| 2,264,055 | 11/1942 | Stocker | 315/336 |
| 2,272,486 | 2/1942 | Stocker | 315/98 |
| 2,273,450 | 2/1942 | Rensschler | 313/211 |
| 2,491,858 | 12/1949 | Hehenkamp et al. | 315/92 |
| 2,765,420 | 10/1956 | Martt | 313/211 |
| 3,363,132 | 1/1962 | Olson | 313/198 |
| 3,504,218 | 3/1970 | Emidy | 315/98 |
| 3,749,968 | 7/1973 | Jones et al. | 313/15 |
| 4,039,880 | 8/1977 | Beijer et al. | 313/15 |

*Primary Examiner*—Harold A. Dixon

*Attorney, Agent, or Firm*—Sughrue, Mion, Zinn, Macpeack and Seas

[57] ABSTRACT

A high pressure discharge lamp in which the restriking voltage and time are significantly decreased. A pair of electrodes are sealably disposed in a tube containing an appropriate amount of mercury. Means is provided for heating at least one of the electrodes for starting the lamp if it has been recently turned off and the mercury vapor pressure inside the tube is high. The heating means is preferably a filament made of a thermally stable material. One terminal of the filament may be connected to one of the electrodes.

43 Claims, 28 Drawing Figures

HIGH PRESSURE DISCHARGE LAMP

This is a continuation of application Ser. No. 235,406, filed Feb. 18, 1981, now abandoned.

BACKGROUND OF THE INVENTION

The present invention relates to a high pressure discharge lamp in which the hot restriking voltage is reduced, and the hot restriking time is decreased compared to prior art lamps of the same type.

In general, in a high pressure discharge lamp such as a high pressure mercury lamp, a metal halide lamp or a high pressure sodium lamp, mercury vapor pressure in the arc tubes of the lamps reaches several atmospheres during operation of the lamps. In these types of lamps, if the lamps are turned off because of a temporary drop of the supply voltage, the lamps cannot be started again immediately when the supply voltage is restored to its normal value. That is, it is impossible to start the lamps again until the temperature of the arc tubes drops to a sufficiently low level that the mercury vapor pressure in the arc tubes is low enough for the discharge to be started. The hot restriking time is typically three to five minutes in a high pressure mercury lamp, eight to fifteen minutes in a metal halide lamp, and two to fifteen minutes in a high pressure sodium lamp. The use and operation of high pressure discharge lamps requiring such a long restriking time is troublesome.

In order to reduce the long restriking time and to restart the lamp substantially instantly, a method has been employed in which the lamp is forcibly restarted by applying a high voltage of 10 to 35 kv between the electrodes. In this method, the applied voltage must be very high, andd therefore the lamp and the lighting device must be specially constructed and consequently large in size and they have a high manufacturing cost. In addition, because of the use of high voltage, installation of the lighting device is unavoidably troublesome.

A conventional 400 w high pressure mercury lamp will be described with reference to FIG. 1 in detail. Main electrodes 2 and 3 are provided at both ends of a quartz arc tube 1 and an auxiliary electrode 4 is provided adjacent to the main electrode 2. Necessary amounts of mercury and argon are sealed in the arc tube 1. The main electrodes 2 and 3 are connected respectively through leads 8 and 9 to a lamp operating apparatus 12 with a ballast. The auxiliary electrode 4 is connected through a lead 7 and a starting resistor 6 having a resistance of several tens of kilo-ohms (KΩ) to the lead 9. In FIG. 1, reference numeral 11 designates a transparent outer bulb enclosing the tube 1 and reference numeral 13 designates a power source.

When the high pressure mercury lamp thus constructed is connected through the lamp operating apparatus 12 to the power source 13 to apply a voltage to the lamp, at first a glow discharge occurs between the main electrode 2 and the auxiliary electrode 4 and current limited by the starting resistor 6 flows. As a result of this auxiliary discharge, a discharge is quickly started between the main electrodes 2 and 3. The current between the main electrodes 2 and 3, the lamp current, is controlled by the lamp operating apparatus 12. The lamp reaches a stable operating state about five minutes after the discharge has been started. The mercury vapor pressure in the arc tube 1 reaches about five atmospheres during operation and a stable mercury discharge is maintained between the main electrodes 2 and 3.

If the high pressure mercury lamp during operation is turned off, for instance, by a temporary drop of the supply voltage, even if the supply voltage is quickly restored to its normal value, the lamp cannot restart the discharge immediately because the mercury vapor pressure is high, typically several atmospheres.

In general, the hot restriking time for a high pressure mercury lamp is three to five minutes as described above. During the time, the temperature of the arc tube decreases, and accordingly the mercury vapor pressure therein decreases. When the temperature of the arc tube drops to about 150° C. from about 600° C. (which is the temperature of the arc tube in operation), the lamp can be restarted. At about 150° C., the mercury vapor pressure in the arc tube is about 3 Torr.

The relation between the time elapsed after the lamp has been turned off and the starting voltage needed to restart the lamp is as shown in FIG. 2. The starting voltage increases with time and reaches its maximum value, higher than 8 kv, in about one minute. In order to restart the discharge at that time, a high voltage higher than 8 kv must be applied to the lamp. As time elapses further, the starting voltage gradually decreases. In about four minutes, the discharge can be started with the ordinary line voltage (for instance, 200 v).

As is apparent from the above description, in order to restart the lamp at any time after it has been turned off, it is necessary for the lamp operating apparatus to be capable of supplying a voltage higher than 8 kv. The voltage applied depends on the type of lamp and output power. However, in practice, the high voltage is in a range from 10 kv to 35 kv.

The inventors have investigated the relation between the mercury vapor pressure in the arc tube and the lamp starting voltage, and have found the relation to follow the plot in FIG. 3. When the mercury vapor pressure is lower than about $10^{-1}$ Torr corresponding to a temperature of the arc tube of lower than about 180° C., the starting voltage increases moderately as the mercury vapor pressure increases. When the mercury vapor pressure exceeds $10^{1}$ Torr, the voltage increases sharply. When the mercury vapor pressure becomes higher than about $10^{2}$ Torr corresponding to a temperature of the arc tube of higher than 260° C., the voltage abruptly increases. Under this condition, it is impossible to restart the lamp with the ordinary line voltage.

When the lamp is started at room temperature, the mercury vapor pressure in the arc tube is about $10^{-3}$ Torr. At this mercury vapor pressure, the lamp starting voltage is low and therefore the lamp can be started with the ordinary line voltage. However, in the hot restrike of the lamp, the discharge cannot be started with the ordinary line voltage because the mercury vapor pressure in the arc tube in operation is about five to fifteen atmospheres, and accordingly the starting voltage is very high. Accordingly, a certain period of time must elapse until the lamp can be restarted. That is, the restrike of the lamp cannot be carried out until the temperature of the arc tube decreases gradually, and reaches about 150° C. or lower, i.e., until the mercury vapor pressure decreases to several Torr or lower.

In order to restart the discharge under the high mercury vapor pressure before the mercury vapor pressure in the arc tube decreases to several Torr or lower thereby to reduce the restriking time, it is necessary to apply a considerably high voltage to the lamp as is apparent from FIG. 3. Especially, when the mercury vapor pressure is higher than 100 Torr, it is, as a practical matter, impossible to start the discharge quickly.

SUMMARY OF THE INVENTION

In view of the foregoing, an object of the invention is to provide a novel high pressure discharge lamp in which the lamp can be restarted under high pressure conditions, especially under the condition that the mercury vapor pressure in the arc tube thereof is at least 100 Torr and the temperature of the arc tube is correspondingly at least about 260° C. To accomplish this, in accordance with the invention, at least one part of one of the electrodes is heated and a predetermined voltage is applied between the electrodes to greatly facilitate the start of discharge. This greatly reduces the restriking time and greatly decreases the voltage required for the hot restrike of the lamp.

A heating element is provided such as to heat one part of the electrodes when the vapor pressure of mercury in the tubes is at least 100 Torr. Preferably the heating means is disposed within the tube and is capable of heating the electrode to at least 500° C. The heating means may be a resistor preferably made of thermally stable material which may be a metal such as tungsten, molybdenum, tantalum, or thoriated tungsten. The resistor is preferably in the form of a filament with an applied voltage of at least 11 v. One end of the filament may be connected to one of the electrodes and the other end of the filament to an external lead such as may be connected to a preheating circuit means. The preheating circuit means is provided independently of the electrode current control circuit which applies current to the electrodes. The filament may be arranged in the vicinity of one of the electrodes and arranged such that a discharge occurs across the filament. The filament, if desired, may be coated with an electron emitting material. It is preferred that the filament be heated to a temperature of at least 500° C. The filament is preferably disposed and formed such that a discharge is caused between both ends of the filament at the same time when the filament is heated. The filament may serve as one of the electrodes.

The heating means is in one preferred embodiment disposed at a position to heat at least one part of one of the pair of electrodes at one end portion of the tube opposite to the end portion of the tube which is at the lowest temperature. The heating means may be disposed so that the head portion of it is within ±5 mm from the tip of one electrode which is provided with the heating means.

In one preferred embodiment, the heating element is a filament which is wound on a rod of one of the electrodes and extended towards one end of the tube. In another preferred embodiment, the tip portion of a rod of one of the electrodes is bent at an angle of 10° to 60° and the heating means is a filament having a portion wound on the rod thus bent and extended towards one end of the tube end portion. Yet further, one of the electrodes may be made from an inner coil of thermally stable metal wire and an outer coil, which extends from one end of the inner coil, wound in such a manner that the outer coil is outside the inner coil and is not in contact with the inner coil. In this case, the inner and outer coils serve also as the heating means. Current is applied to the inner and outer coils from the two end portions of the inner and outer coils.

Otherwise, at least one of the electrodes may be made from a spiral coil of a material such as tungsten or thoriated tungsten wire. A winding finish end of the coil extends along the axis of the coil inside the coil. Here, the electrode serves as the heating means.

Still further, at least one of the electrodes may be made from an electrode rod of thermally stable metal, an inner coil of thermally stable metal wound around the electrode rod, and an outer coil connected to a winding finish end of the inner coil. The outer coil is wound outside the inner coil in such a manner that the outer coil is not in contact with the inner coil. The electrode thus serves as the heating means as well.

At least one of the electrodes may be composed of a V-shaped filament having a top portion directed towards the center of the tube. Also, the pair of electrodes may be sealed in one end portion of the tube with the heating means being formed of a filament connected to one of the electrodes at one end only so that the filament is that the same potential as the electrode. The filament may be disposed so that the shortest distance between the filament and the other electrode is at most 80% of the distance between arc spots which form on the electrodes when the lamp is in a stable operating state.

DESCRIPTION OF THE PREFERRED EMBODIMENTS

The invention will be described with reference to the preferred embodiments thereof.

Embodiment 1

Figure 4:
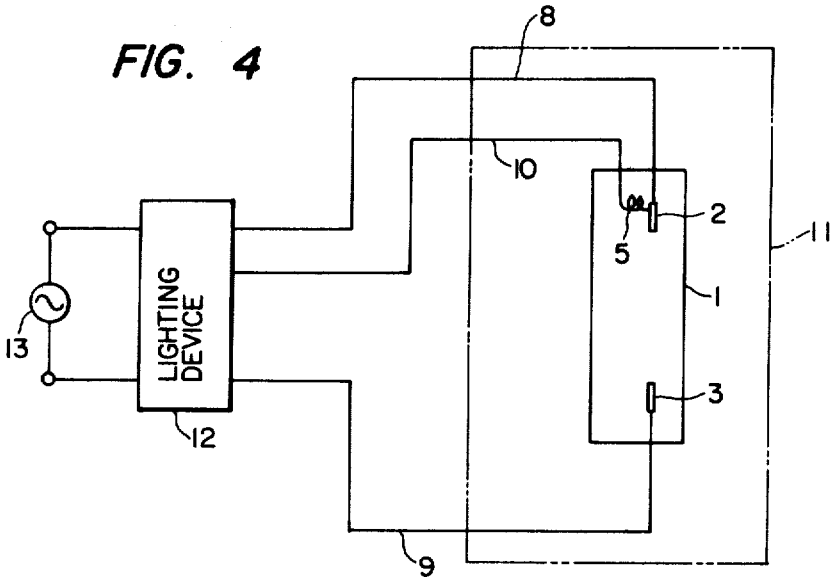
FIG. 4 is a schematic circuit diagram showing an Embodiment 1 of the invention.

FIG. 4 is a schematic circuit diagram of a high pressure discharge lamp constructed according to the invention. A transparent tube 1 made of quartz in a 400 w high pressure mercury lamp has main electrodes 2 and 3 disposed of opposite ends thereof. The main electrode 3 is connected to a filament 5 which is made of tungsten. Necessary amounts of mercury and argon are sealed in the tube 1. The main electrodes 2 and 3 are connected respectively through leads 8 and 9 to a lamp operating apparatus 12 which includes a stabilizer. The other end of the filament connected to the main electrode 2 is connected through a lead 10 to the lamp operating apparatus. In FIG. 4, reference numeral 11 designates a transparent outer bulb in which the transparent tube 1 is mounted.

When the high pressure mercury lamp according to the invention thus constructed is connected to a power source 13 through the lamp operating apparatus 12, the discharge is immediately started between the main electrodes 2 and 3, and current controlled by the lamp operating apparatus 12 flows between the main electrodes 2 and 3. In about five minutes after the discharge has been started, the mercury lamp reaches stable operation. The mercury vapor pressure in the tube 1 is then about five atmospheres and the high pressure mercury discharge is stably maintained between the main electrodes 2 and 3.

Figure 1:
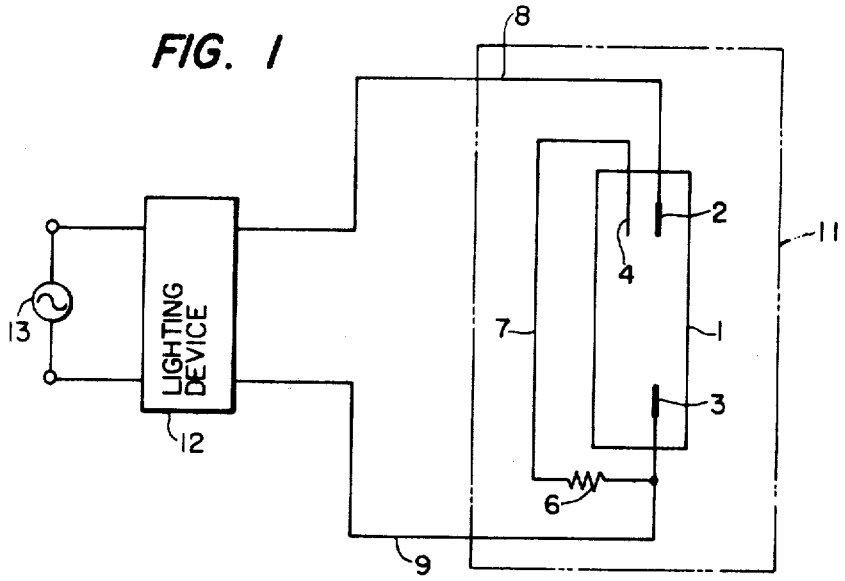
FIG. 1 is a schematic circuit diagram showing a conventional high pressure discharge lamp.
Figure 2:
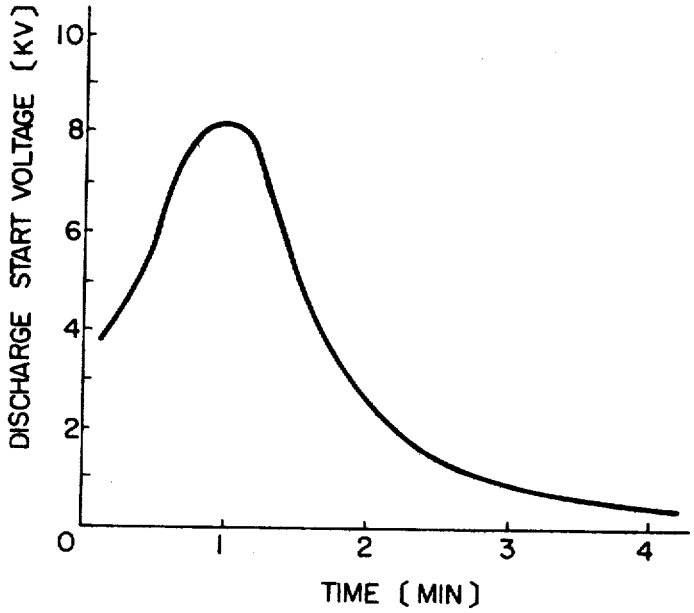
FIG. 2 is a characteristic diagram indicating the relation of the starting voltage with time elapsed after the lamp has been turned off.
Figure 3:
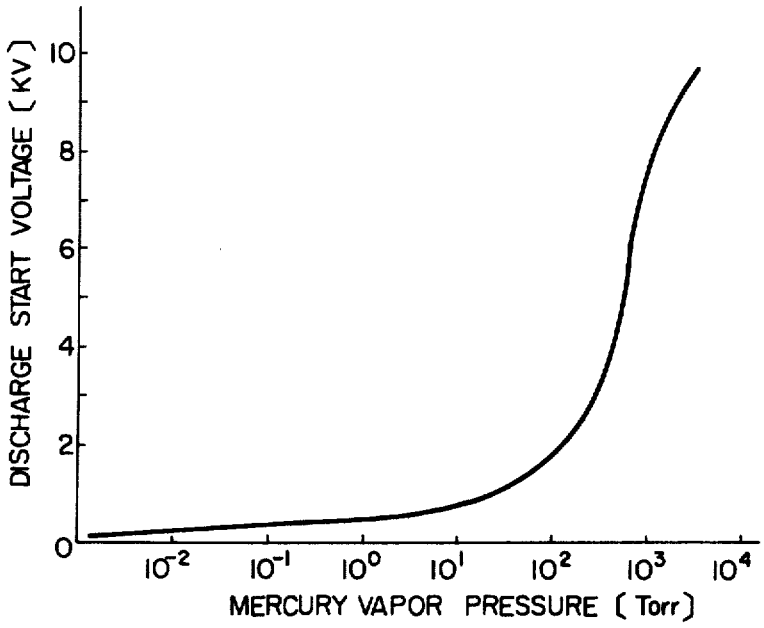
FIG. 3 is a characteristic diagram indicating the relation between mercury vapor pressures in a sealed tube and starting voltages.

A high pressure mercury lamp constructed according to the invention can be started again with the following procedure, after the lamp has been turned off. At first, a voltage of 15 v is applied across the leads 8 and 10 so that current flows from the lamp operating apparatus 12 to the filament 5 to heat the filament 5. Once the filament 5 has been heated, a voltage is applied across the main electrodes 2 and 3 through the leads 8 and 9 by the lamp operating apparatus 12 to start the discharge between the main electrodes 2 and 3. In this embodiment, the time required for restarting since the voltage is applied to the filament 5 is only several seconds. Thus, the restriking time of the above-described mercury lamp is much shorter than that of the conventional mercury lamp shown in FIG. 1.

The reason why the restriking time is reduced with the invention as described above will now be described.

Figure 5:
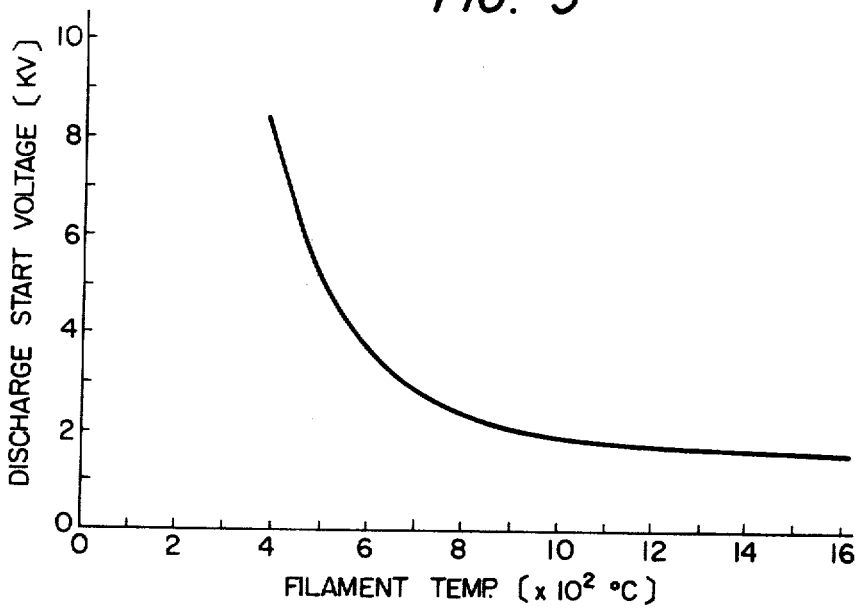
FIG. 5 is a characteristic diagram indicating the relation between filament temperature and starting voltage in a high pressure discharge lamp according to Embodiment 1 of the invention.

FIG. 5 is a graphical representation plotting the starting voltage with filament temperature under the condition that one minute has passed since the high pressure mercury lamp shown in FIG. 4 has been turned off. More specifically, the curve in FIG. 5 was obtained by plotting starting voltage under a high mercury pressure with the temperature of the filament 5 being changed by varying the current flowing therein. As is apparent from FIG. 5, when the temperature of the filament 5 reaches 500° C., the starting voltage decreases abruptly, and when the temperature of the filament is higher than 600° C., the starting voltage decreases moderately as the filament temperature increases.

That is, as is clear from FIG. 5, electrons are readily emitted from the filament, as the filament is heated by current flowing through it. When the filament is sufficiently hot and voltage is applied across the two electrodes, the discharge is readily caused between the electrodes. Thus, the necessary starting voltage for the hot restrike is decreased to a value lower than about 2,000 v even under a mercury vapor pressure of higher than 100 Torr.

As is apparent from the above description, in Embodiment 1, it is unnecessary that the high voltage power source required for restarting the mercury lamp be large in size and expensive as is needed for the conventional discharge lamp, and so the power source can be relatively small in size and low in cost. Furthermore, as the necessary voltage is low, the wiring requirements are not as severe as for the conventional discharge lamp. That is, the mercury lamp of the invention can be operated under conditions similar to those used for an ordinary high pressure discharge lamp.

In the above-described Embodiment 1, the upper limit of the temperature of the electrode, including the filament, during heating is about 2,300° C. If the temperature exceeds 2,300° C., the material of the electrode is liable to evaporate and accordingly the filament may be broken.

In the above-described embodiment of the invention in which a filament is provided, the starting effect is much improved if the voltage drop across the filament which is caused when current is applied to the filament is set higher than about 11 v. If the voltage drop across the filament at the heating time is higher than 11 v, discharge is caused between both ends of the filament. With an applied voltage of greater than 11 v, the electrode will be heated to the required temperature. Therefore, by the subsequent discharge, a number of ions and electrons are diffused in the discharge space in the tube which facilitates the discharge between the main electrodes with the result that restrike is more readily effected under the high mercury vapor pressure.

The above-described Embodiment 1 can be modified as follows:

(A) In the above-described embodiment, the heating element is the filament 5. However, the heating element may be a resistor of sufficient capacity.

(B) It is most preferable that the material of the filament 5 be tungsten; however, it may be a thermally stable metal such as molybdenum or tantalum.

(C) In Embodiment 1, the high pressure discharge lamp is so designed that, as the first condition of design, the restriking voltage is reduced. For an ordinary start at room temperature for which the starting voltage is low, the discharge can be started without heating the filament. However, the discharge lamp may be started with the filament heated as in the case of the restrike of the discharge lamp.

(D) In Embodiment 1, the tungsten filament for directly heating the electrode is connected to the main electrode. However, the electrode may be heated indirectly or may be heated from outside the arc tube.

(E) In the above-described Embodiment 1, only one electrode is heated. However, both of the electrodes may be heated at both ends of the arc tube. In this modification, the discharge start voltage is much lower than that of a discharge lamp in which only one electrode is heated.

(F) In the above-described Embodiment 1, the heating filament is connected to the electrode. However, a structure may be employed in which the filament is not physically in contact with the main electrode but is electrically connected to the main electrode. Furthermore, if the filament is provided electrically independently, then an electrical circuit for heating the filament can be operated independently of the lamp current control circuit.

(G) In a small high pressure discharge lamp in which the lamp current is relatively small, it is unnecessary to provide the main electrode and the filament separately. That is, the filament may be so designed that it serves as the main electrode as well.

(H) While Embodiment 1 has been described with reference to a 400 w high pressure mercury lamp, the invention is not limited to high pressure mercury lamps of this lamp power. That is, the same effect can be obtained by applying the technical concept of the invention to a high pressure discharge lamp such as a metal halide lamp or a high pressure sodium lamp which has ordinarily a long restriking time because of the high mercury vapor pressure in the arc tube.

Embodiment 2

This embodiment provides a 400 w high pressure discharge lamp which is constructed by coating the filament 5 of the 400 w high pressure discharge lamp in Embodiment 1 with an electron emission material, for example, barium-calcium-strontium tungstate, yttrium oxide and beryllium oxide mixture.

The start and restrike characteristics of the discharge lamp of Embodiment 2 are similar to those of the discharge lamp of Embodiment 1.

Figure 6:
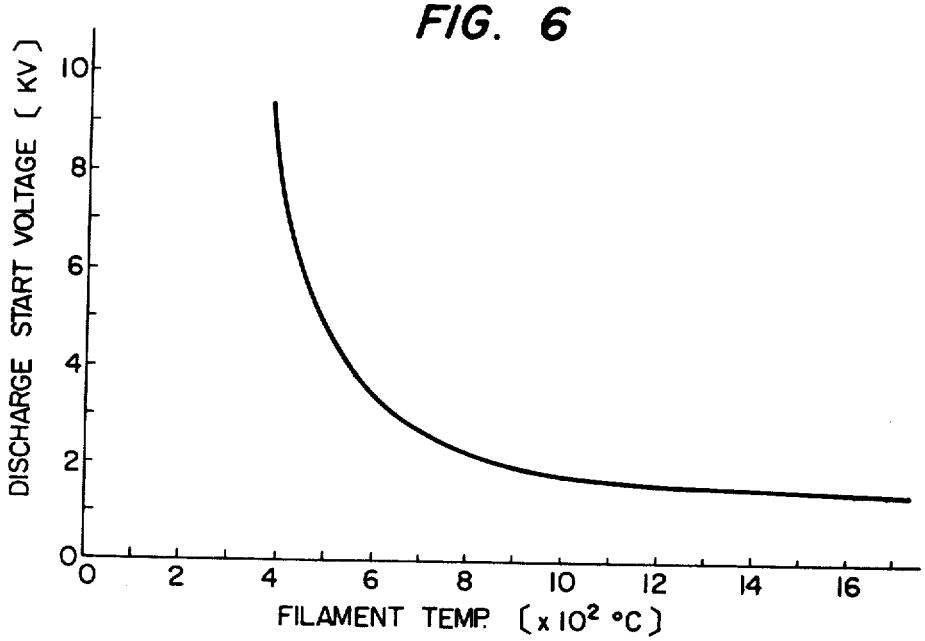
FIG. 6 is a characteristic diagram indicating the relation between filament temperature and starting voltage in a high pressure discharge lamp according to an Embodiment 2 of the invention.

FIG. 6 is a plot of starting voltage with filament temperature when one minute has passed since a lamp of Embodiment 2 was turned off. As is apparent from FIG. 6, when the temperature of the filament 5 reaches 500° C., the starting voltage decreases abruptly, and in temperature ranges higher than 600° C., the starting voltage decreases gradually as the filament temperature increases.

In Embodiment 2 also, the starting effect is much improved by setting an upper limit of the temperature of the electrode, including the filament, about 2,300° C., as in Embodiment 1, and by setting the voltage drop across the filament at the heating to a value higher than 11 v.

Also as in Embodiment 1, the discharge lamp of Embodiment 2 can be modified as described in paragraphs (B), (C), (E), (F), (G) and (H) above. Furthermore, in Embodiment 2, the electron emission material for coating the filament is described above as being prepared by mixing barium-calcium-strontium tungstate, yttrium oxide and beryllium oxide, although it should be noted that the electron emission material is not limited thereto or thereby. That is, barium oxide, calcium oxide, strontium oxide, thorium oxide, and rare earth metal oxides may be employed suitably according to the type of the discharge lamp.

Embodiment 3

Provided by this embodiment is a 400 w high pressure discharge lamp which is constructed by replacing the filament 5 of the 400 w high pressure discharge lamp in Embodiment 1 by a filament made of a thoriated tungsten wire containing 1% of thorium oxide.

The start and restrike characteristics of the discharge lamp of Embodiment 3 are similar to those of the discharge lamp of Embodiment 1.

Figure 7:
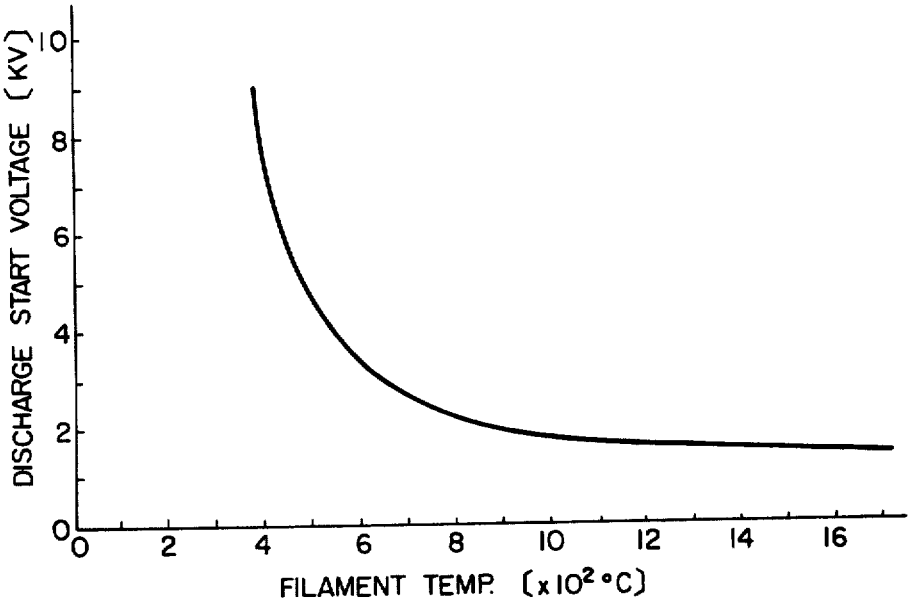
FIG. 7 is a graphical representation indicating the relation between filament temperature and starting voltage in a high pressure discharge lamp according to an Embodiment 3 of the invention.

FIG. 7 is a plot of starting voltage with filament temperature under the condition that one minute has passed since the lamp was turned off. As is apparent from FIG. 7, when the temperature of the filament 5 increases to 500° C., the starting voltage decreases abruptly. In temperature ranges above 600° C., the starting voltage decreases moderately as the filament temperature increases.

In Embodiment 3 alos, the start effect is much improved by setting the upper limit of the temperature of the electrode, including the filament, about 2,300° C. and by setting the voltage drop across the filament during heating to higher than 11 v, as in the case of Embodiment 1.

In Embodiment 3, the filament is described above as being a thoriated tungsten wire containing 1% of thorium oxide. However, the content of thorium oxide may be any value in the range of 0.1 to 3%.

Embodiment 4

Provided by Embodiment 4 is a 400 w high pressure discharge lamp which is formed by arranging the filament 5 of the 400 w high pressure discharge lamp in Embodiment 1 in the vicinity of one of the two electrodes 2 and 3 which is at the end of the tube which is opposite to the end at the lowest temperature; for instance, in the vicinity of the electrode which is located on the upper side in the vertical tube.

The start and restrike characteristics of the discharge lamp of Embodiment 4 are similar to those of the discharge lamp of Embodiment 1. Moreover, the starting voltage for the lamp of Embodiment 4 is lower than that of a discharge lamp in which the filament is provided at the lowest temperature end.

Figure 8:
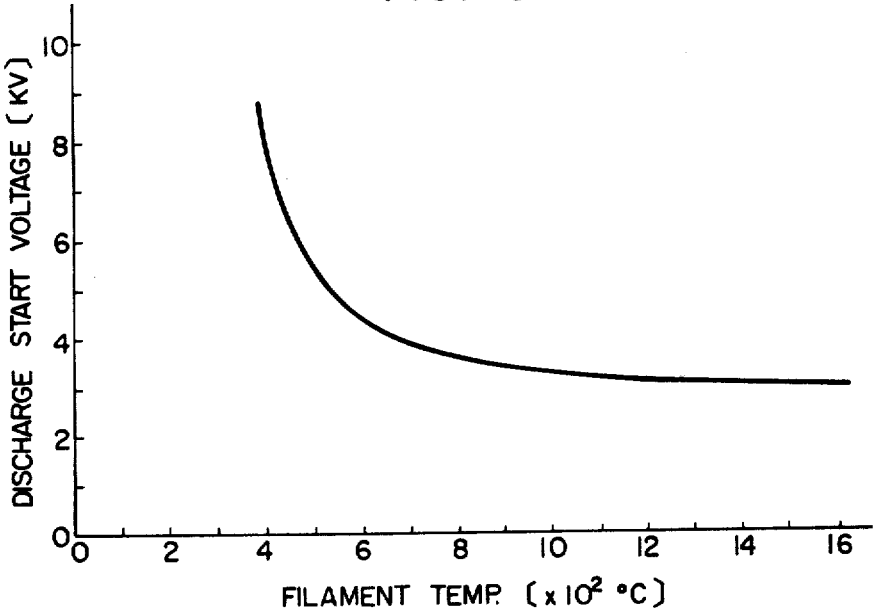
FIG. 8 is also a graphical representation indicating the relation between filament temperature and starting voltage in a high pressure discharge lamp according to an Embodiment 4 of the invention.

FIG. 8 is a graphical representation indicating starting voltage with filament temperature under the condition that one minute has passed since the lamp was turned off for a lamp of Embodiment 4. In Embodiment 4 also, as is apparent from FIG. 8, when the filament temperature increases to 500° C., the starting voltage decreases abruptly. For filament temperatures higher than about 600° C., the starting voltage decreases moderately as the filament temperature increases.

Embodiment 4 can also be practiced more effectively by setting the upper limit of the temperature of the electrode, including the filament, about 2,300° C. and by setting the voltage drop across the filament when the filament is heated with current to higher than 11 v. The discharge lamp of Embodiment 4 can also be modified as described in paragraphs (A), (B), (C), (D), (F), (G) and (H) above in the discussion of Embodiment 1.

The effect of the invention is especially significant with a high pressure sodium lamp and a metal halide lamp. In the case of a high pressure sodium lamp, with the filament provided on the lowest temperature side, the lowest temperature is raised by the heat of the filament and accordingly the vapor pressures of the mercury and sodium are increased as a result of which the starting voltage is increased. In the case of the metal halide lamp, with the filament provided on the lowest temperature side, the vapor pressure of metal halide is increased as a result of which the starting voltage is increased. For the metal halide lamp according to Embodiment 4, the service life of the filament is increased because a chemical reaction between the filament and the metal halide is suppressed.

Embodiment 5

Figure 9:
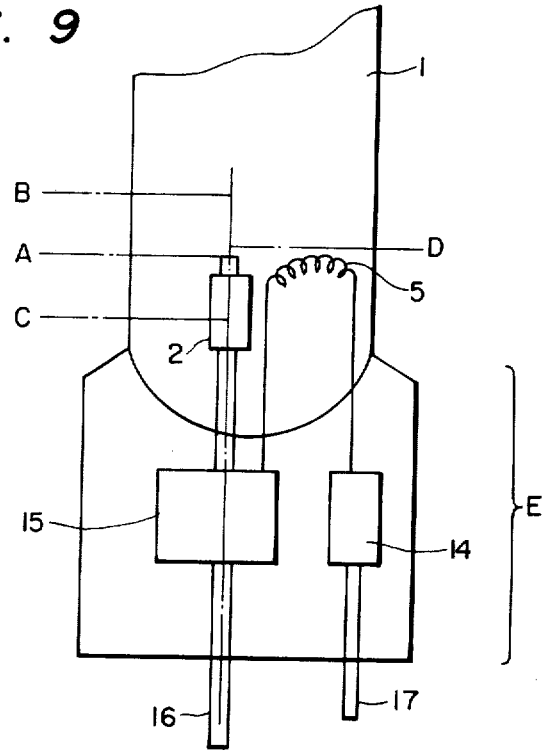
FIG. 9 is an enlarged view showing an end portion of a tube in a high pressure discharge lamp according to an Embodiment 5 of the invention.

Embodiment 5 provides a 400 w high pressure discharge lamp which is constructed by modifying the filament 5 of the 400 w high pressure discharge lamp of Embodiment 1 as shown in FIG. 9. One end of the filament 5 is connected through a molybdenum foil segment 15 to which the main electrode 2 is connected and further through a current line 16 to the lead 8. The other end is connected through another molybdenum foil segment 14 and another current supplying line 17 to the lead 10. The head portion D of the filament 5 is set between a position C which is spaced by 5 mm towards a sealing portion E from the tip A of the main electrode 2 and a position B which is removed by 5 mm in the opposite direction from the tip A of the main electrode 2. The start and restrike characteristics of the discharge lamp of Embodiment 5 are also similar to those of the discharge lamp of Embodiment 1.

Figure 10:
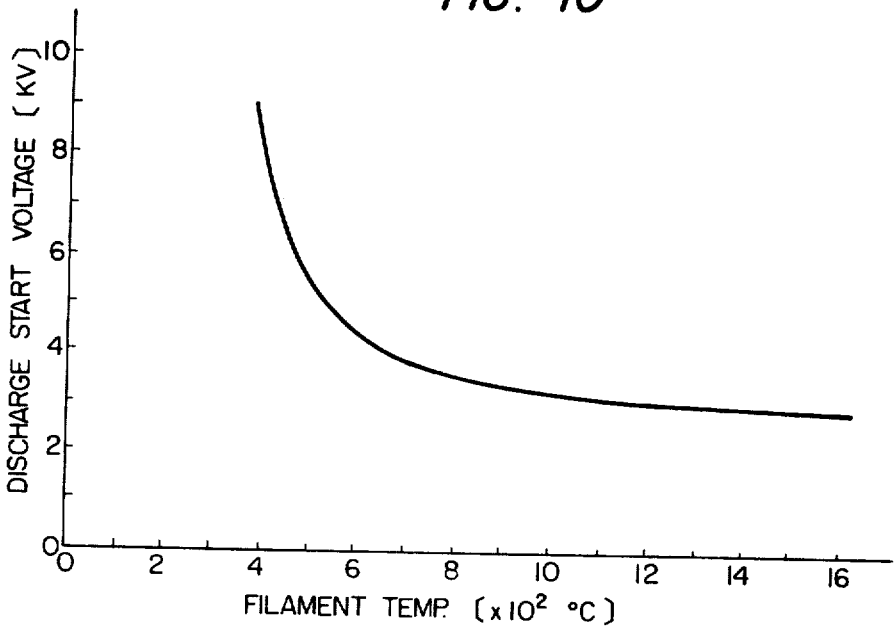
FIG. 10 is a graphical representation indicating the relation between filament temperature and starting voltage in a high pressure discharge lamp according to an Embodiment 5 of the invention.

FIG. 10 is a graphical representation indicating starting voltage with filament temperature under the condition that one minute has passed since the lamp was turned off. In Embodiment 5 also, as is apparent from FIG. 10, when the filament temperature increases to 500° C., the starting voltage decreases abruptly, while for filament temperatures higher than 600° C., the starting voltage decreases moderately as the filament temperature increases.

Setting the head portion D of the filament 5 between the positions B and C as described above is preferably due to the following reason. If the head portion D of the filament were to be set above the position B, an arc spot formed on the head portion of the filament would have a tendency not to shift, as required, to the tip A of the main electrode. Even if the arc spot does shift to the tip A of the main electrode, the arc will contact a part of the filament. This causes the tube blackening due to evaporation of the material of the filament. At worst, the filament can be broken. On the other hand, if the head portion D of the filament 5 were to be set below the position C closer to the sealing portion E, the tip A of the main electrode 2 would be insufficiently heated and therefore the starting voltage would not decrease sufficiently.

Embodiment 5 can also be practiced more effectively by setting the upper limit of the temperature of the electrode, including the filament, 2,300° C. and by setting the voltage drop across the filament when the filament is heated to higher than 11 v as in Embodiment 1. The discharge lamp in Embodiment 5 can also be modified as described in paragraphs (B), (C), (D), (E), (F) and (H) above in the discussion of Embodiment 1.

Embodiment 6

Figure 11:
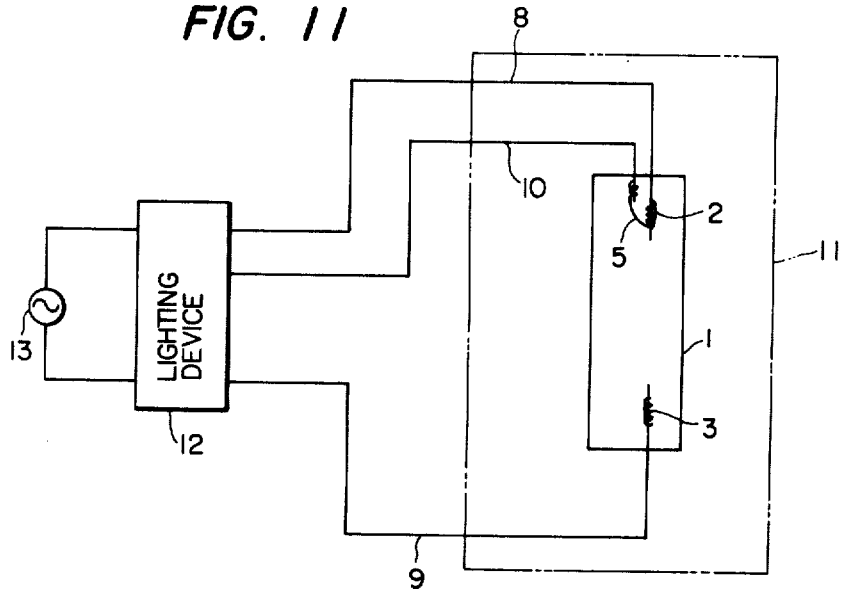
FIGS. 11 and 12 are a schematic circuit diagram showing a high pressure discharge lamp according to an Embodiment 6 of the invention and a graphical representation indicating the relation between filament temperature and starting voltage thereof, respectively.

In a 400 w high pressure mercury lamp according to Embodiment 6 of the invention, as shown in FIG. 11, two main electrodes 2 and 3 are provided at respective ends of a transparent tube 1 made of quartz. One end portion of a filament 5 made of a tungsten is wound on the main electrode 2 and connected thereto while the other end portion is extended towards the end of the transparent tube. Necessary amounts of mercury and argon are sealed in the tube 1. The two main electrodes 2 and 3 are connected, respectively, through leads 8 and 9 to a lamp operating apparatus 12. The other end portion of the filament is connected through a lead 10 to the lamp operating apparatus 12. In FIG. 11, reference numeral 11 designates a transparent outer bulb enclosing the tube 1 and reference numeral 13 designates a power source.

The high pressure mercury lamp thus constructed according to Embodiment 6 has start and restrike characteristics similar to those of the discharge lamp of Embodiment 1. In the high pressure mercury lamp of Embodiment 6, the filament can be readily fit into the limited space in the end portion of the tube and the various characteristics of the lamp are not adversely affected by the presence of the filament.

Figure 12:
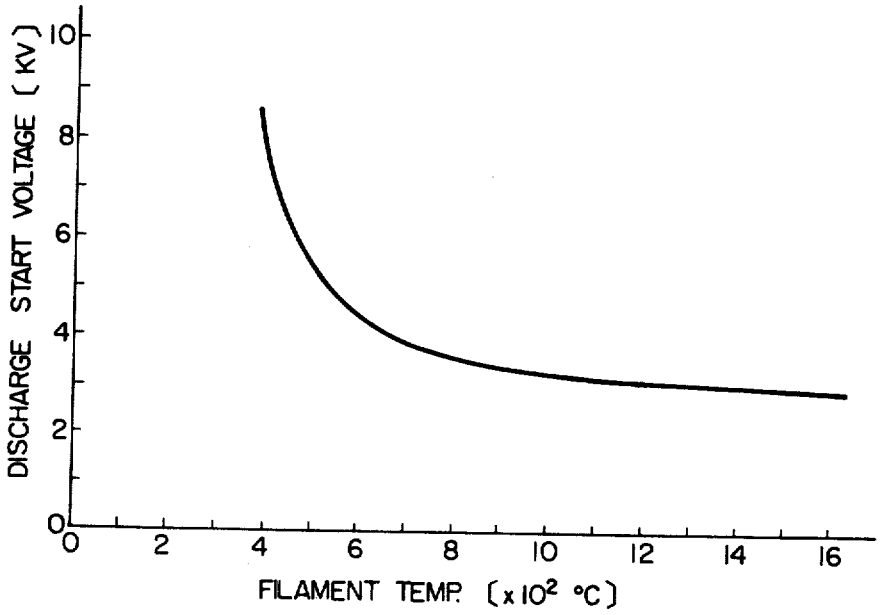

FIG. 12 is a graphical representation indicating starting voltage with filament temperature under the condition that one minute has passed since the lamp was turned off for a lamp of Embodiment 6. As is apparent from FIG. 12, in Embodiment 6 also, when the filament temperature increases to 500° C., the starting voltage decreases abruptly, while for filament temperatures higher than 600° C., the starting voltage decreases gradually as the filament temperature increases.

Embodiment 6 can also be practiced more effectively be setting the upper limit of the temperature of the electrode, including the filament, about 2,300° C., and by setting the voltage drop across the filament when the latter is heated to higher than 11 v as in Embodiment 1. The mercury lamp in Embodiment 6 can also be modified as described in paragraphs (B), (C), (E) and (H) in the discussion of Embodiment 1.

In Embodiment 6, the filament is preferably a double-layer coil manufactured by winding a tungsten wire in two layers. However, the filament may be a three-layer coil or a tungsten wire which is not wound, if desired.

Embodiment 7

Figure 13:
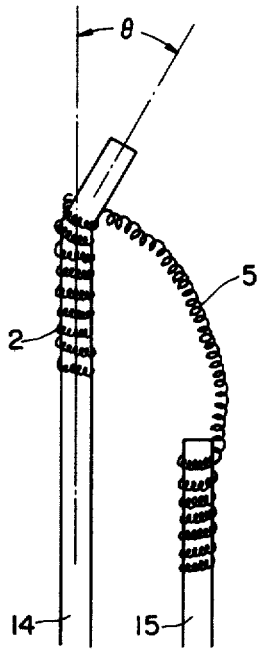
FIGS. 13 and 14 are an enlarged view showing a part of an electrode of a high pressure discharge lamp according to an Embodiment 7 of the invention and a characteristic diagram indicating the relation between filament temperature and starting voltage thereof, respectively.

This embodiment provides a 400 w high pressure discharge lamp which is formed by modifying the filament 5 and the main electrode 2 of the 400 w high pressure discharge lamp in Embodiment 6 as shown in FIG. 13.

The end portion of the rod 14 of the main electrode 2 is bent at an angle $\theta$ of 10° to 60°, and one end portion of a filament 5 made of tungsten is wound on the bent end portion. The other end portion of the filament 5 extends towards the end of the transparent tube and is then wound on an auxiliary electrode 15 which is connected to the lead 10.

The discharge lamp of Embodiment 7 has start and restrike characteristics similar to those of the discharge lamp of Embodiment 1. Furthermore, in the discharge lamp of Embodiment 7, the filament can be readily accommodated in the limited space available in the end portion of the transparent tube. In addition, because the end portion of the rod of the main electrode is bent 10° to 60° as described above, an arc spot formed on the filament at the start time will quickly shift to the tip of the rod and the various advantageous characteristics of the lamp are not affected by the presence of the filament.

Figure 14:
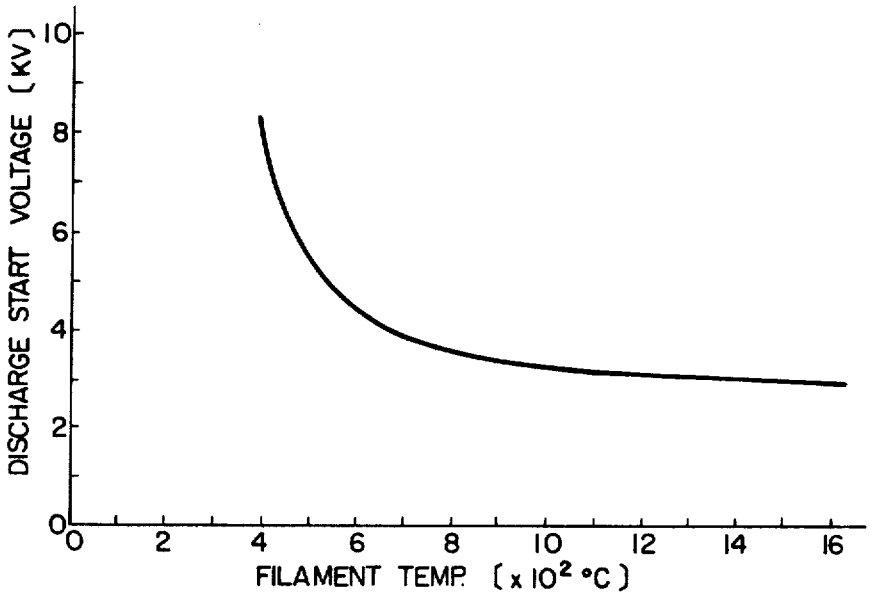

FIG. 14 indicates starting voltage with filament temperature under the condition that one minute has passed since the lamp was turned off for a lamp of Embodiment 7. As is clear from FIG. 14, in Embodiment 7 also, when the filament temperature increases to 500° C., the starting voltage decreases abruptly, while for filament temperatures higher than 600° C., the starting voltage decreases moderately as the filament temperature increases.

Embodiment 7 can also be practiced more effectively by setting the upper limit of the temperature of the electrode, including the filament, at about 2,300° C., and by setting the voltage drop across the filament to 11 v as in the case of Embodiment 1.

The discharge lamp of Embodiment 7 can also be modified as described in paragraphs (B), (C), (E) and (H) in the description of Embodiment 1.

In Embodiment 7, the filament is preferably a double-layer coil manufactured by winding a tungsten wire in two layers. However, the filament may be a three-layer coil or a tungsten wire which is not wound, if desired.

Embodiment 8

Figure 15:
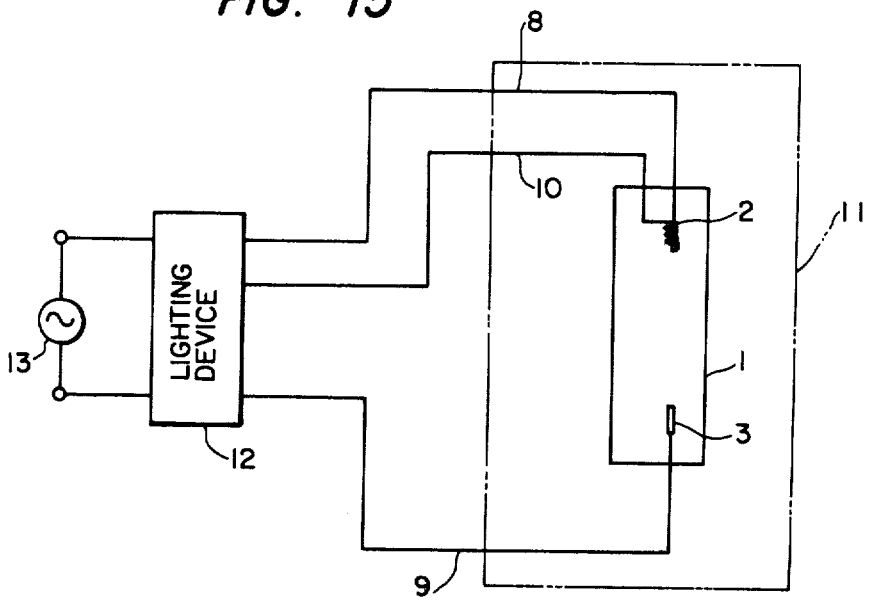
FIGS. 15, 16 and 17 are a schematic circuit diagram showing a high pressure discharge lamp according to an Embodiment 8 of the invention, a diagram showing an electrode thereof, and a graphical representation indicating the relation between temperatures of an outer coil forming the electrode and starting voltage thereof, respectively.
Figure 16:
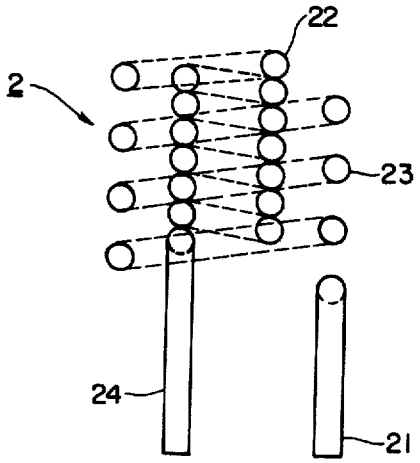

A 400 w high pressure mercury lamp according to Embodiment 8 of the invention is as shown in FIGS. 15 and 16. Main electrodes 2 and 3 are arranged at opposite ends of a transparent tube 1 of quartz. The main electrode 2 is made up of an inner coil 22 of tungsten and an outer coil 23 which is wound over the inner coil 22. More specifically, one end portion of the inner coil 22 is extended and wound over the inner coil 22 to form the outer coil 23. The outer coil 23 is wound with a pitch such that the outer coil is not in contact with the inner coil 23 and the turns of the outer coil are not in contact with one another. A voltage is applied between one end 24 of the outer coil 23 and one end 21 of the inner coil 22 to apply current to the electrode thereby to heat the latter. Necessary amounts of mercury and argon gas are sealed in the tube 1 of the 400 w high pressure mercury lamp with the electrodes described above.

In the main electrodes, one end 21 of the inner coil 22 is connected to a lead 8 and one end 24 of the outer coil 23 is connected to a lead 10. The other main electrode 3 is connected through a lead 9 to a lamp operating apparatus 12. The leads 8 and 10 are also connected to the operating apparatus 12. In FIG. 15, reference numeral 11 designates a transparent outer bulb encasing the tube 1.

As is apparent from the above description, the high pressure mercury lamp of Embodiment 8 is constructed by modifying the heating element of the discharge lamp in Embodiment 1 to form the outer coil 23. The mercury lamp of Embodiment 8 has start and restrike characteristics similar to those of the mercury lamp in Embodiment 1.

Figure 17:
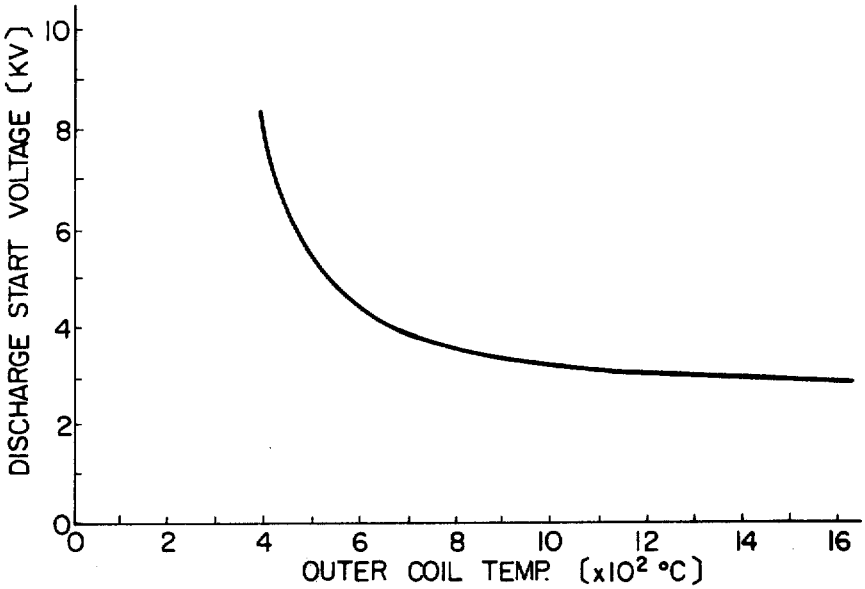

FIG. 17 shows the relation between starting voltage and the outer coil temperature under the condition that one minute has passed since the lamp was turned off. In Embodiment 8 also, as is apparent from FIG. 17, when the temperature of the outer coil 23 increases to 500° C., the starting voltage decreases abruptly, while when the outer coil temperature is higher than 600° C., the starting voltage decreases slowly as the outer coil temperature increases.

Embodiment 8 can also be practiced more effectively by setting the voltage drop across the heating element, namely, the outer coil 23 during heating, to a value higher than 11 v.

The mercury lamp of Embodiment 8 can also be modified as described in paragraphs (C), (E) and (H) in the description of Embodiment 1.

In Embodiment 8, the main electrode is made of tungsten; however, the inner coil 22 and the outer coil 23 may be coated with electron emission material so that the electrode can emit electrons more readily. In Embodiment 8, the material of the coils is preferably tungsten although it may be molybdenum, tantalum, or thoriated tungsten.

Embodiment 9

Figure 18:
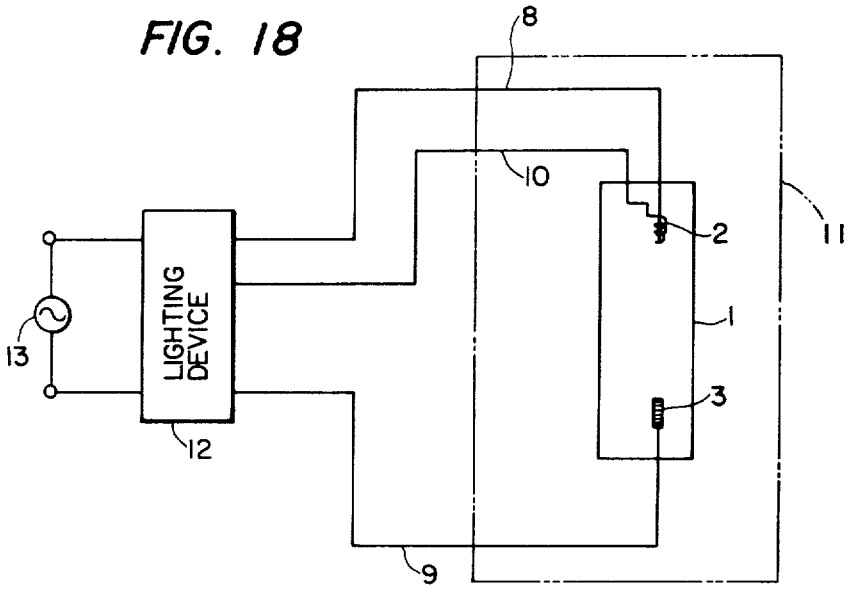
FIGS. 18, 19 and 20 are a schematic circuit diagram showing a high pressure discharge lamp according to an Embodiment 9 of the invention, a diagram showing an electrode thereof, and a graphical representation indicating the relation between main electrode temperature and starting voltage thereof, respectively.
Figure 19:
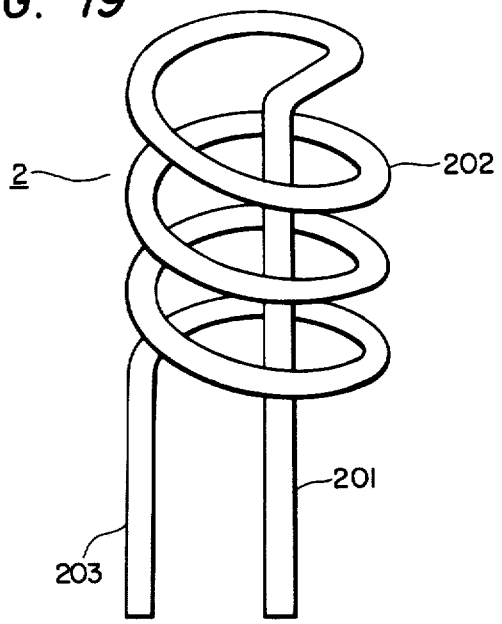

A 400 w high pressure mercury lamp according to this embodiment is constructed as shown in FIGS. 18 and 19. Two main electrodes 2 and 3 are arranged at opposite ends of a transparent tube 1 of quartz, respectively. The main electrode 2 is made of a tungsten wire as shown in FIG. 19. More specifically, the main electrode 2 is formed by a coil 202, which is prepared by spirally winding tungsten wire, and an end wire 201 which extends from one end of the coil 202 along the axis of the coil 202 towards the other end of the coil 202. A voltage is applied between the ends 201 and 203 of the coil 202 to apply current to the electrode 2 thereby to heat the electrode 2.

Necessary amounts of mercury and argon are sealed in the tube 1 of the 400 w high pressure mercury lamp. The main electrode 3 is connected through a lead 9 to a lamp operating apparatus 12 and the end wire 201 of the main electrode 2 and the end 201 of the coil 202 are connected respectively through leads 8 and 10 to the operating apparatus. In FIG. 18, reference numeral 11 designates a transparent outer bulb encasing the tube 1. That is, the high pressure mercury lamp of Embodiment 9 is constructed by modifying the heating element composed of the main electrode and the filament of the discharge lamp of Modification 1 to form a single unit which is the main electrode 2 of Embodiment 1. The start and restrike characteristics of the mercury lamp of Embodiment 9 are similar to those of the lamp of Embodiment 1.

Figure 20:
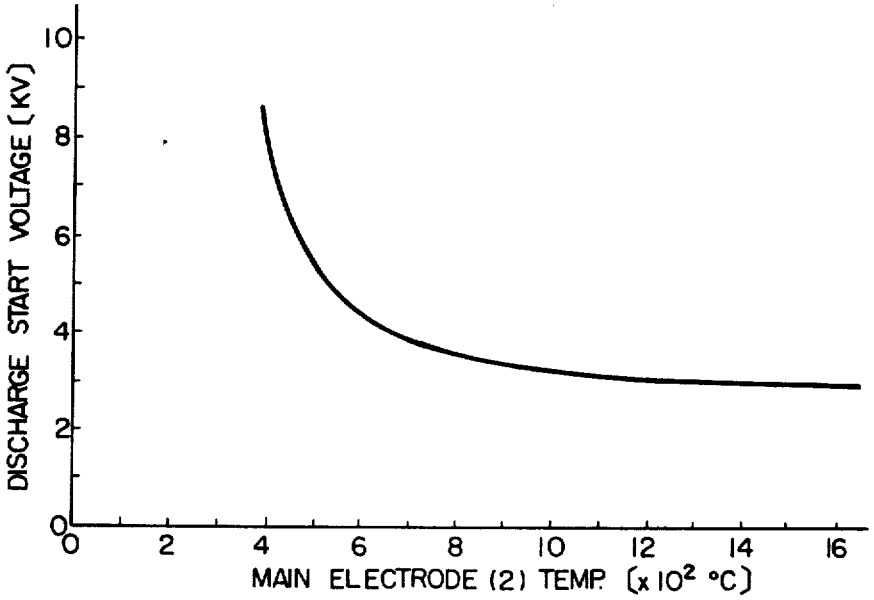

FIG. 20 indicates the relations between starting voltage and temperatures of the main electrodes 2 under the condition that one minute has passed since the lamp was turned off. As is apparent from FIG. 20, in Embodiment 9 also, when the temperature of the main electrode 20 increases to 500° C., the starting voltage decreases abruptly, while when the main electrode temperature is higher than 600° C., the starting voltage decreases gradually as the temperature of the main electrode 2 increases.

Embodiment 9 can also be practiced more effectively by setting the voltage drop across the electrode 2 to a value higher than 11 v as in Embodiment 1.

The mercury lamp of Embodiment 9 can be modified as described in paragraphs (C), (E) and (H) in the discussion of Embodiment 1. In Embodiment 9, the material of the main electrode 2 is preferably tungsten although it may be made of thoriated tungsten, and the electrode may be coated with an electron emission material, if desired.

Embodiment 10

Figure 21:
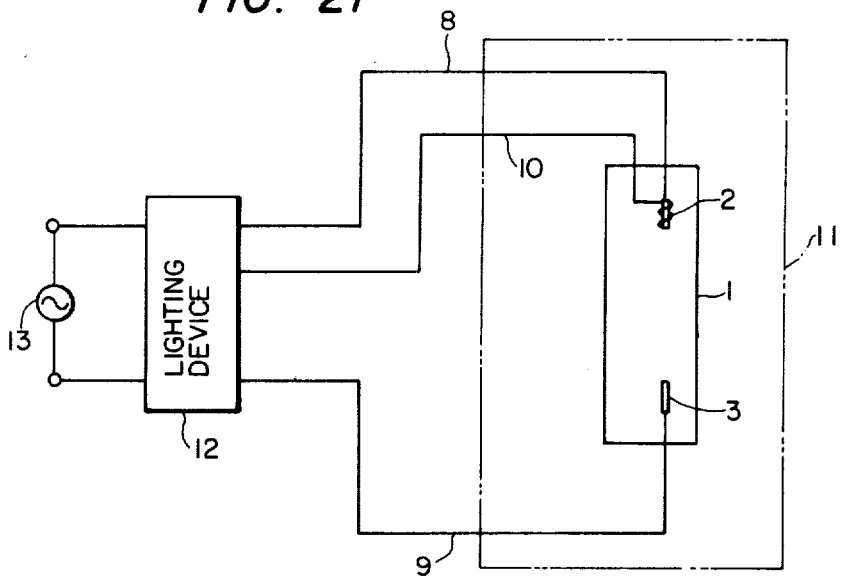
FIGS. 21, 22 and 23 are a schematic circuit diagram showing a high pressure discharge lamp according to an Embodiment 10 of the invention, an explanatory diagram showing an electrode thereof, and a graphical representation indicating the relation between temperature of an outer coil forming an electrode and starting voltages, respectively.
Figure 22:
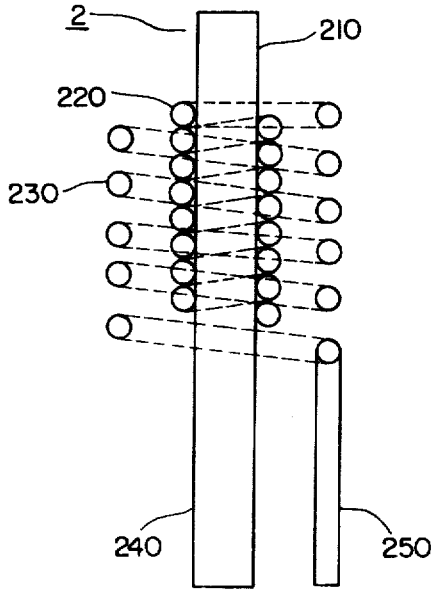

A 400 w high pressure mercury lamp of Embodiment 10 is as shown in FIGS. 21 and 22. Main electrodes 2 and 3 are arranged at opposite ends of a transparent tube 1 made of quartz. The main electrode 2 is formed as shown in FIG. 22. More specifically, in the main electrode 2, an inner coil 220 of tungsten is wound around an electrode rod 210 of tungsten and one end portion of the inner coil 220 is extended so that it is wound around the inner coil 220 to form an outer coil 230 with the outer coil 230 being spaced apart from the inner coil 220 and the turns of the outer coil being not in contact with one another. A voltage is applied between the end 240 of the electrode rod 210 and the end 250 of the outer coil 230 to supply current to the electrode 2 to heat the electrode 2. Necessary amounts of mercury and argon are sealed in the tube 1 of the 400 w high pressure mercury lamp. The main electrodes 2 and 3 are connected respectively through leads 8 and 9 to a lamp operating apparatus 12. The end 250 of the outer coil 230 is connected through a lead 10 to the operating apparatus 12. In FIG. 21, reference numeral 11 designates a transparent outer bulb enclosing the tube 1. That is, the mercury lamp in Embodiment 10 is constructed by modifying the heating element or the filament of the mercury lamp in Embodiment 1 to form the outer coil 230. The mercury lamp of Embodiment 10 also has start and restrike characteristics similar to those of the lamp of Embodiment 1.

Figure 23:
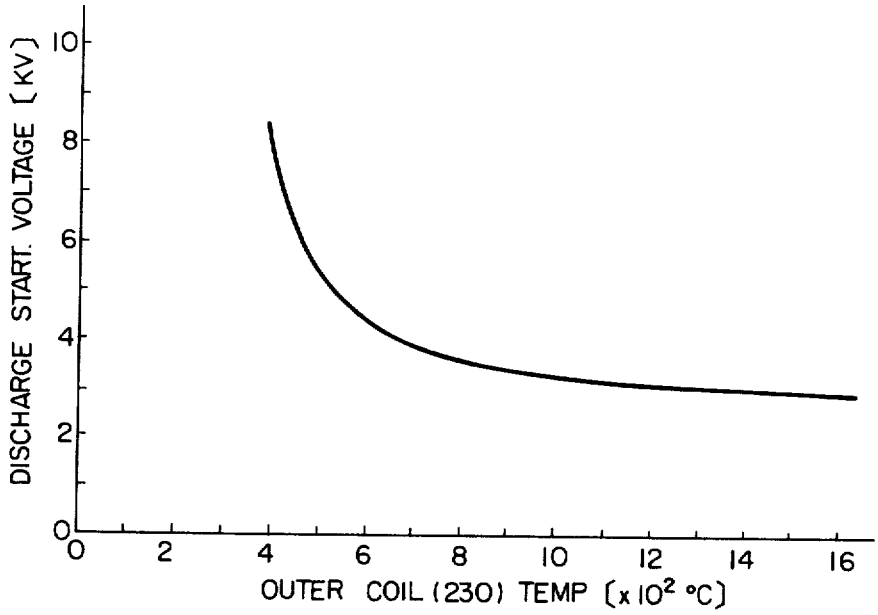

The relation between starting voltages and temperatures of the outer coil 230 under the condition that one minute has passed since the lamp was turned off is as indicated in FIG. 23. In Embodiment 10 als, as is apparent from FIG. 23, when the temperature of the outer coil 230 increases to 500° C., the starting voltage decreases abruptly, while when the temperature is higher than 600° C., the starting voltage decreases moderately as the temperature of the outer coil 230 increases.

Embodiment 10 can also be practiced more effectively be setting the voltage drop between the end 250 of the outer coil 250 and the end 240 of the electrode rod 210 to a value higher than 11 v during heating as in the case of Embodiment 1.

The mercury lamp of Embodiment 10 can also be modified as described in paragraphs (C), (E) and (H) in the discussion of Embodiment 1.

In Embodiment 10, the electrode is preferably made of tungsten although the inner and outer coils 220 and 230 may be coated with electron emission material to facilitate the emission of electron therefrom. Furthermore, the coils may be made of molybdenum, tantalum or thoriated tungsten instead of tungsten, if desired.

Embodiment 11

Figure 24:
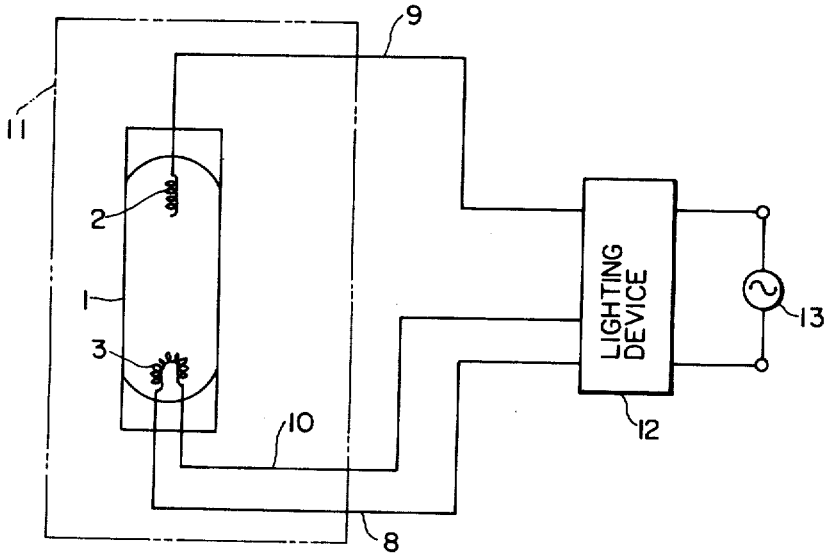
FIGS. 24 and 25 are a schematic circuit diagram showing a high pressure discharge lamp according to an Embodiment 11 of the invention and a characteristic diagram indicating the relation between temperatures of a filament serving as an electrode also and starting voltages, respectively.

Embodiment 11 provides a 100 w high pressure mercury lamp which is fabricated as shown in FIG. 24. Main electrodes 2 and 3 are arranged at opposite ends of a transparent tube 1 of quartz. The main electrode 3 is a V-shaped filament which is made of a tungsten wire containing 1% of thorium oxide. The top of the V-shaped filament extends towards the center of the tube 1. Required amounts of mercury and argon are sealed in the tube 1. The main electrodes 2 and 3 are connected respectively through leads 8 and 9 to a lamp operating apparatus 12. One end of the filament serving as the main electrode 3 is connected through a lead 10 to a preheating circuit in the operating apparatus 12. In FIG. 24, reference numeral 11 designates a transparent outer bulb enclosing the tube 1 and reference numeral 13 designates a power source. That is, the high pressure mercury lamp of Embodiment 11 is formed by modifying the heating element made up of the main electrode and the filament in Embodiment 1 to form a V-shaped filament which extends towards the center of the tube 1. The start and restrike characteristics of the high pressure mercury lamp of Embodiment 11 are also similar to those of the lamp of Embodiment 1.

Figure 25:
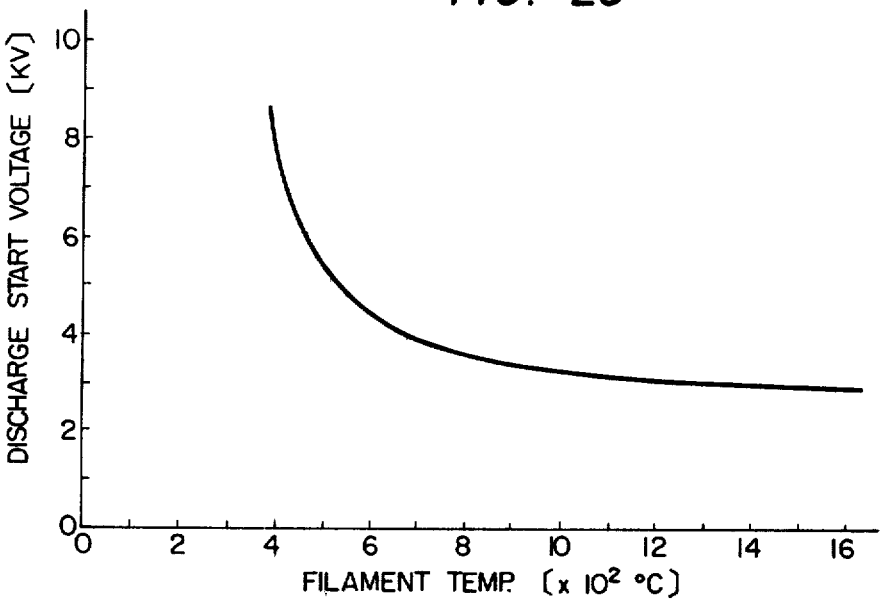

FIG. 25 indicates starting voltage with filament temperature under the condition that one minute has passed since the lamp was turned off for the lamp of Embodiment 11. As is apparent from FIG. 25, when the filament temperature increases to 500° C., the starting voltage decreases abruptly, while when the filament temperature is higher than 600° C., the starting voltage decreases moderately as the filament temperature increases.

Embodiment 11 can also be practiced more effectively by setting the upper limit of the temperature of the electrode, including the filament, about 2,300° C. and by setting the voltage drop across the filament during heating to a value higher than 11 v.

Embodiment 11 has been described with reference to a 100 w high pressure mercury lamp. However, it should be noted that the technical concept of Embodiment 11 can be applied not only to various high pressure mercury lamps of different lamp power but also to high pressure discharge lamps such as a metal halide lamp or a high pressure sodium lamp which have a long restriking time because of the high mercury vapor pressure in the tube.

In the mercury lamp described above, the filament is described as being made of a thoriated tungsten wire containing 1% of thorium oxide; however, it may be made of a thoriated tungsten wire containing anywhere from 0.1 to 3% of thorium oxide. Furthermore, the filament may be made of a thermally stable metal such as tungsten. If necessary, the filament may be coated with an electron emission material. In the latter case, the starting voltage is further decreased. In the above-described embodiment, the filament is provided for only one electrode; however, the filaments may be provided for both of the electrodes so that the filaments are heated simultaneously. In this case, the starting voltage can be made lower than that of the mercury lamp in which the filament is provided for only one electrode.

Embodiment 12

Figure 26:
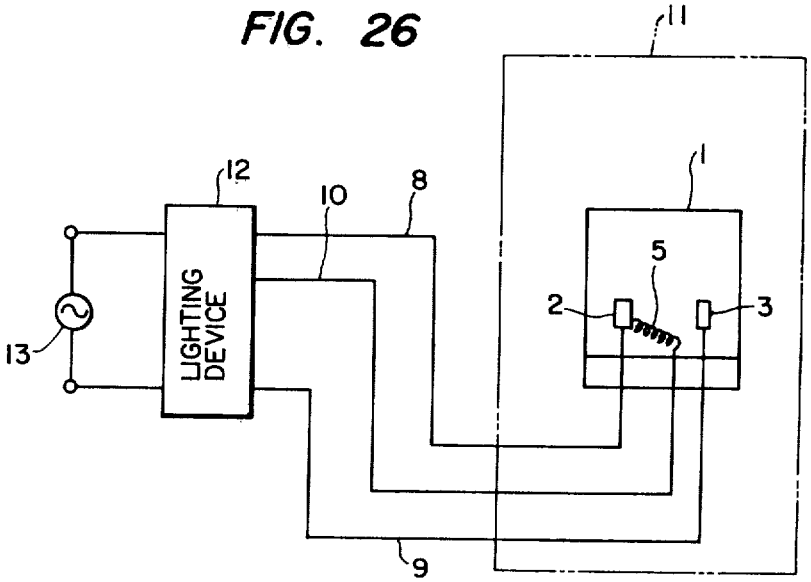
FIGS. 26 and 27 are a schematic circuit diagram showing a high pressure discharge lamp according to an Embodiment 12 of the invention and an explanatory diagram showing an arc tube thereof, respectively.
Figure 27:
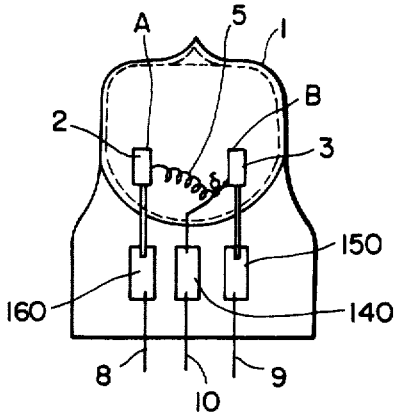

In a transparent tube 1 made of quartz, two main electrodes 2 and 3 are arranged with their longitudinal axes parallel with each other as shown in FIGS. 26 and 27. A filament 5 made of a tungsten wire is connected to the main electrode 2. The other end of the filament 5 and the main electrodes 2 and 3 are connected to molybdenum foil segments 140, 150 and 160, respectively, and they are sealed in the transparent tube 1 at these connecting points. Similarly, as in the above-described embodiments, necessary amounts of mercury and argon are sealed in the tube 1. The molybdenum foil segments 140, 150 and 160 are connected respectively through leads 10, 9 and 8 to a lamp operating apparatus 12. In FIG. 26, reference numeral 11 designates a transparent outer bulb enclosing the tube 1.

The distance between the point A on the main electrode 2 and the point B on the main electrode 3 is set to 1.1 cm and the shortest distance δ between the filament 5 and the main electrode 3 is set to 3 mm in the high pressure mercury lamp of Embodiment 12.

When the lamp thus constructed is connected through the operating apparatus 12 to the power source 13 and voltage is applied to the lamp, discharge is started between the electrodes 2 and 3 immediately, and current in an amount controlled by the operating apparatus 12 then flows between the main electrodes 2 and 3. The lamp reaches a stable operation about five minutes since the discharge was started. In this state, arc spots are formed at the points A and B (FIG. 27) due to the following reason. In the vicinity of the tube wall, the arc is cooled causing it to tend to move away from the tube wall. Therefore, arc spots are formed at the points A and B or at the ends of the main electrodes which are away from the tube wall.

During operation, the mercury vapor pressure in the tube 1 reaches about seven atmospheres, and the discharge between the main electrodes 2 and 3 is stably maintained.

In restriking the high pressure mercury lamp, at first, current is applied from the operating apparatus 12 through the leads 10 and 8 to the filament 5 to heat, after which a voltage is applied between the main electrodes 2 and 3. As a result, an auxiliary discharge is caused between the filament 5 connected to the main electrode 2 and the main electrode 3. The resultant arc moves towards the center of the tube 1 thus moving away from the tube wall, while the arc which is located at the point on the filament which is closest to the main electrode 3 moves along the filament 5 towards the center of the tube 1 and finally reaching the end A of the main electrode 3 where its position is stable. Several minutes after this, the mercury lamp reaches a stable operating state.

In Embodiment 12, the distance δ between the filament 5 and the main electrode 3 is set to 3 mm and the temperature of the heated filament is set to about 1,900° C. According to experiments, at any time after the lamp was turned off, an auxiliary discharge may be caused when the voltage across the main electrodes is lower than the supply voltage 200 v. Furthermore, although the distance between the points A and B corresponding to the distance between the main electrodes is 1.1 cm in this embodiment, the auxiliary discharge was quickly shifted to the main discharge and the stable operation was quickly attained with the predetermined discharge voltage. As the starting voltage can be lower than 200 v in this embodiment, it is unnecessary to use a circuit for generating a particularly high voltage.

In addition, if a person handles a high pressure mercury lamp and operating apparatus of the prior art carelessly, he may be injured by a high voltage electrical shock. However, as the high voltage generating circuit is eliminated according to the invention, the chance of receiving such an electrical shock is eliminated. Furthermore, the chance of explosion due to sparks if the lamp is used in an inflammable atmosphere is also reduced for the same reason. Thus, Embodiment 12 is preferable in the point of view of safety.

A high pressure mercury lamp in which the filament 5 is disposed behind the main electrode 2 or the distance between the filament 5 and the main electrode 3 is longer than 80% of the distance between the arc spots on the two main electrodes, was produced for purposes of comparison. However, it was impossible to restart the mercury lamp with a low voltage because the distance between the filament 5 and the main electrode 3 was too long.

Furthermore, a high pressure mercury lamp in which the distance between the main electrodes is shorter and the distance between the filament 5 and the main electrode 3 is set to 80% of the distance between the arc spots was produced for purposes of comparison. However, its starting properties were not so good as that of the above-described mercury lamp. The reason for this is that the thermal electron emission is obstructed by the presence of the main electrode in the vicinity of the filament.

If the distance between the main electrode is reduced, then disadvantageously the discharge sustaining voltage in the stable operation is decreased, and the efficacy and the life of the lamp are adversely affected. As the amount of thermionic emission depends on the temperature of the filament, the temperature of the filament affects the restrike characteristic greatly. For instance in the case where no current was supplied to the filament, even in a lamp in which the distance δ between the filament and the main electrode 3 was 1 mm, 1,000 v was required to start the auxiliary discharge about one minute after the lamp was turned off. The distance δ may be further reduced; however, it is not practical to make the distance excessively short, because, for instance, in the case of $\delta=1$ mm, the auxiliary discharge will scarcely shift to the main discharge between the main electrodes. In general, as the distance δ is decreased, the difficulty of shifting the auxiliary discharge to the main discharge is increased. In the above-described embodiment with $\delta=3$ mm, the effect obtained by applying current to the filament becomes significant as the temperature increases and voltage lower than 200 v can be used to restart the lamp at about 1,900° C. at any time. However, if the filament temperature is increased to 2,200° C. or higher, the filament tends to quickly be consumed and the light output adversely affected. At worst the filament may break. Thus, it has been found that if the distance between the filament and the main electrode 3 is set to less than 80% of the distance between the arc spots on the main electrodes to increase the electric field strength and the filament is heated to emit electron, then the starting voltage between the filament and the main electrode 3 can be considerably decreased. Furthermore, it has also been found that if the filament is connected to the main electrode 2, the auxiliary discharge will smoothly shift to the main discharge between the main electrodes.

In Embodiment 12 as described above, the filament is stated as being made of tungsten; however, it may be made of other materials such as molybdenum. Furthermore, the electron emission characteristic can be improved by using a tungsten wire containing thorium oxide or thorium or by coating the tungsten wire with a metal oxide having a low work function.

In the above-described Embodiment 12, the filament is described as being connected to the main electrode although the main electrode itself may be used as the filament. In this case, the distance between the arc spots in the stable operation should be long enough to maintain the predetermined discharge voltage and the shortest distance between the filament and the main electrode confronted therewith should be correspondingly reduced.

Embodiment 12 has been described with reference to a 150 w high pressure mercury lamp. However, the same technical concept can be equally applied to a 150 w metal halide lamp to achieve substantially the same effect. Furthermore, the same technical concept can be applied to various high pressure mercury lamps of different lamp powers and to other high pressure discharge lamps while the equivalent effect is retained.

In Embodiment 12, the operating apparatus is so designed that the application of current to the filament is suspended as soon as the auxiliary discharge occurs. This is done to prevent the flow of unnecessary current to the filament and accordingly to prevent damage or breakage of the filament. However, if the current can be controlled suitably, then it is unnecessary to suspend the application of current to the filament immediately.

Furthermore in Embodiment 12, in order to apply current to the filament, the filament is connected through the lead 10 to the operating apparatus. A circuit composed of a heat sensitive switch and a heater may be provided in the outer bulb of the lamp to control the current of the filament. In this case, a conventional ballast can be used as the operating apparatus without modification and a two-terminal base can be used for the lamp. Accordingly a conventional simple lighting fixture can be used without modification.

In the above-described Embodiment 12, the application of a voltage between the main electrode and the application of the current to the filament are started at the same time. However, the voltage may be applied between the main electrode after the temperature of the filament is sufficiently increased. Moreover, the application of the current to the filament may be suspended before the application of the voltage. That is, all that is necessary is to apply the voltage to the electrodes when the temperature of the filament has been increased to the predetermined value.

In Embodiment 12, the operating apparatus applies 200 v to the main electrodes. However, in the case of a metal halide lamp, it may be designed to apply a voltage higher than 200 v to the main electrode.

As is apparent from the above description, in the high pressure discharge lamp including a transparent tube in which at least mercury is sealed and two main electrodes are provided at the ends of the tube, according to the invention, a predetermined voltage is applied between the two main electrodes under the condition that at least one part of one of the electrodes is heated. Therefore, even under a high mercury vapor pressure in restrike of the lamp since the lamp has been turned off, the discharge is readily started and the restriking time is significantly reduced. Furthermore, the voltage required for restriking the lamp at any time since the lamp has been turned off is greatly reduced. Thus, the high voltage discharge lamp according to the invention, unlike a conventional lamp, can be restarted with a quite small operating apparatus, which has a lower manufacturing cost than a conventional operating apparatus.

Figure 28:
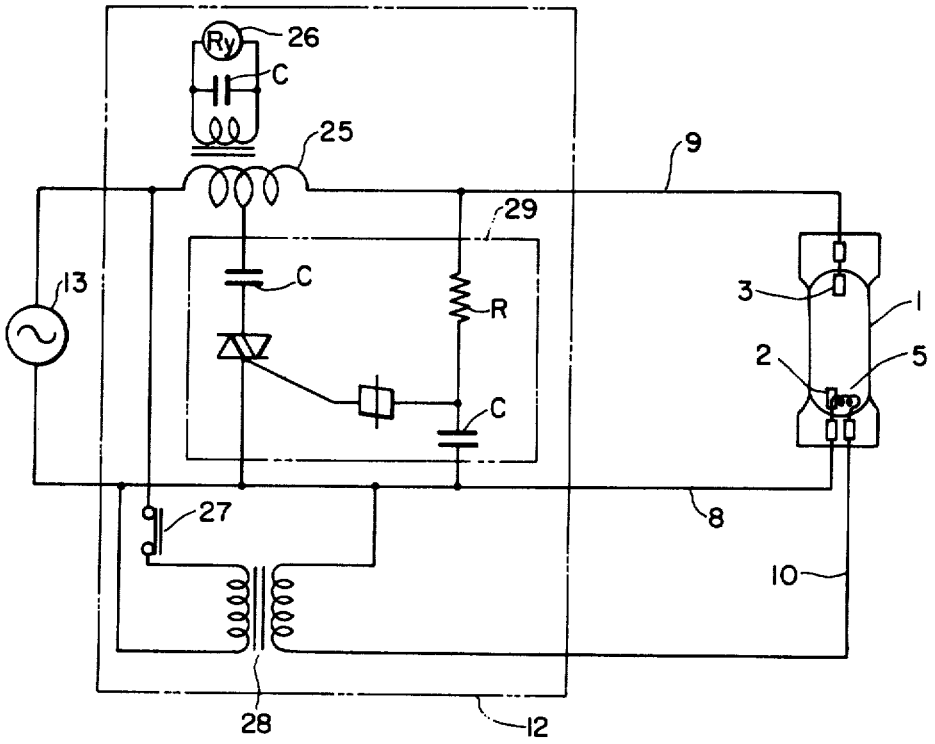
FIG. 28 is a schematic diagram of a lamp operating apparatus used with a lamp of the invention.

An example of the operating apparatus 12 will be described with reference to FIG. 28. Upon an application of voltage from a power source 13, a voltage of magnitude determined by a transformer 28 is applied to a filament 5 to thereby heat the filament 5. Upon the application of a pulse signal generated by a pulse generator circuit 29 between main electrodes 2 and 3, due to an electron emission effect from the filament 5, an electric discharge occurs in the gap between the main electrodes 2 and 3. In this case, an electric current controlled by a choke coil 25 flows through the main electrodes 2 and 3. The current flow is detected to thereby activate a relay 26 as a result of which a relay contact 27 is opened and thus the heating of the filament 5 is terminated.

What is claimed is:

1. In a method for operating a high pressure discharge lamp comprising a transparent tube in which at least mercury is sealed and in which the quantity of mercury in said tube if sufficient to provide a vapor pressure of mercury in said lamp of at least 100 Torr immediately as said lamp has been switched off after operating in a steady state and is still hot, and a pair of electrodes disposed in said tube, the improvement comprising, heating at least of said electrodes for re-starting said lamp at least when said lamp is hot.

2. The method of claim 1, wherein said heating means is inside said tube closely adjacent said at least one of said electrodes.

3. The method of claim 1, wherein said step of heating comprises heating said at least one electrode to a temperature of at least 500° C.

4. The method of claim 1, wherein said heating means comprises a resistor to which current is applied for causing said heating.

5. The method of claim 4, wherein said resistor comprises a filament made of a thermally stable metal.

6. The method of claim 5, wherein said thermally stable metal comprises a material selected from the group consisting of tungsten, molybdenum, tantalum and thoriated tungsten.

7. The method of claim 4, wherein said filament is arranged in the vicinity of one of said electrodes and is arranged such that a discharge occurs across said filament during said starting of said lamp.

8. The method of claim 4, wherein said filament is coated with an electron emissive material.

9. The method of claim 4, wherein said heating means comprises a filament wound on a rod of one of said electrodes, said filament extending towards one end of said tube from an end of said electrode.

10. A high pressure discharge lamp comprising: a transparent tube in which at least mercury is sealed, the amount of mercury sealed in said tube being such that the vapor pressure of mercury in said lamp is at least 100 Torr immediately after said lamp is placed in the off state after reaching a stable operating temperature in the on state; a pair of main electrodes disposed confronting one another in said tube; and means for heating at least one of said electrodes for starting said lamp immediately after said lamp is placed in the off state after reaching a stable operating temperature in the on state, said heating means being provided closely adjacent said at least one of said electrodes.

11. The high pressure discharge lamp as claimed in claim 10, wherein said heating means is provided in said tube.

12. The high pressure discharge lamp as claimed in claim 10, wherein said heating element means is capable of heating said electrode to at least 500° C.

13. The high pressure discharge lamp as claimed in claim 11, wherein said heating means comprises a resistor to which current is applied to heat.

14. The high pressure discharge lamp as claimed in claim 13, wherein said resistor comprises a filament made of a thermally stable metal.

15. The high pressure discharge lamp as claimed in claim 14, wherein said thermally stable metal comprises tungsten.

16. The high pressure discharge lamp as claimed in claim 14, wherein said thermally stable metal comprises molybdenum.

17. The high pressure discharge lamp as claimed in claim 14, wherein said thermally stable metal comprises tantalum.

18. The high pressure discharge lamp as claimed in claim 14, wherein said thermally stable metal comprises thoriated tungsten.

19. The high pressure discharge lamp as claimed in claim 14 further comprising means for applying a voltage across said filament of at least 11 v.

20. The high pressure discharge lamp as claimed in claim 14, wherein one end of said filament is connected to one of said electrodes and the other end of said filament is connected to preheating circuit means.

21. The high pressure discharge lamp as claimed in claim 14 further comprising a filament preheating circuit provided independently of a current control circuit for applying current to said electrodes.

22. The high pressure discharge lamp as claimed in claim 14, 20 or 21, wherein said filament is arranged in the vicinity of one of said electrodes and arranged such that a discharge occurs across said filament.

23. The high pressure discharge lamp as claimed in claim 11, wherein said heating element comprises a filament of thermally stable material coated with an electron emission material.

24. The high pressure discharge lamp as claimed in claim 23 further comprising means for passing a current through said filament of a magnitude to heat said filament to at least 500° C.

25. The high pressure discharge lamp as claimed in claim 23 or 24, wherein said filament is disposed such a discharge is caused between both ends of said filament at the same time when said filament is heated.

26. The high pressure discharge lamp as claimed in claim 23, wherein said filament serves as one of said electrodes.

27. The high pressure discharge lamp as claimed in claim 10, wherein said heating means is disposed at a position to heat at least one part of one of said pair of electrodes located at one end portion of said tube opposite to the end portion of said tube which is at the lowest temperature.

28. The high pressure discharge lamp as claimed in claim 10, wherein said heating means is disposed so that an end portion of said heating means is located in a range of plus or minus five millimeters from said at least one electrode toward a sealing portion of said electrode.

29. The high pressure discharge lamp as claimed in claim 20, wherein a part of said at least one electrode which is heated is made of a filament of thermally stable material.

30. The high pressure discharge lamp as claimed in claim 20 or 21, wherein said heating means comprises a resistor which is heated with current.

31. The high pressure discharge lamp as claimed in claim 20 or 21, wherein said heating means is disposed such that a discharge occurs between both ends of said heating means when said heating means is heated.

32. The high pressure discharge lamp as claimed in claim 10, wherein said heating element comprises a filament wound on a rod of one of said electrodes, said filament extending towards one end of said tube from an end of said electrode.

33. The high pressure discharge lamp as claimed in claim 32, wherein said filament is disposed such that a discharge is caused between both ends of said filament at the same time when said filament is heated.

34. The high pressure discharge lamp as claimed in claim 10, wherein a tip portion of a rod of one of said electrodes is bent at an angle of 10° to 60°, and said heating means comprises a filament having a portion thereof wound on said rod thus bent and extending towards one end of said tube from said tip portion of said electrode.

35. The high pressure discharge lamp as claimed in claim 34, wherein said filament is disposed such that a discharge is caused between both ends of said filament at the same time when said filament is heated.

36. The high pressure discharge lamp as claimed in claim 10, wherein at least one of said electrodes comprises an inner coil of a thermally stable meatl wire and an outer coil which extends from one end of said inner coil, said outer coil being wound in such a manner that said outer coil is outside said inner coil and is not in contact with said inner coil, said inner and outer coils serving as said heating means, and current is applied to said inner and outer coils from two ends of said inner and outer coils.

37. The high pressure discharge lamp as claimed in claim 10, wherein at least one of said electrodes comprises a spiral coil of a material selected from the group consisting of tungsten and thoriated tungsten wire, with a winding finish end of said coil extending along the axis of said coil inside said coil wherein said electrode serves as said heating means, and wherein said discharge lamp is started by applying a voltage between said electrodes at both ends of said tube.

38. The high pressure discharge lamp as claimed in claim 10, wherein at least one of said electrodes comprises an electrode rod made of a thermally stable metal, an inner coil made of a thermally stable metal wound around said electrode rod, and an outer coil connected to a winding finish end of said inner coil, said outer coil being wound outside said inner coil in such a manner that said outer coil is not in contact with said inner coil, wherein said electrode serves as said heating means.

39. The high pressure discharge lamp as claimed in claim 10, wherein at least one of said electrodes comprises a V-shaped filament having a head portion directed towards the center of said tube.

40. The high pressure discharge lamp as claimed in claim 31, wherein said filament is disposed such that a discharge is caused between both ends of said filament at the same time when said filament is heated.

41. The high pressure discharge lamp as claimed in claim 31 or 32, wherein said filament is coated with an electron emission material.

42. The high pressure discharge lamp as claimed in claim 10, wherein said pair of electrodes is sealed in one end portion of said tube, and said heating means comprises a filament connected to one of said electrodes at one end only so that said filament is at the same potential as said one electrode, said filament being so disposed that the shortest distance between said filament and the other electrode is at most 80% of the distance between arc spots formed on said electrodes when said lamp is in a stable operation.

43. The high pressure discharge lamp as claimed in claim 36, wherein said heating means comprises a filament made of thermally stable material and further comprising first and second molybdenum foil segments coupled to ends of said filament.

* * * * *